United States Patent [19]

Eisenberg

[11] 3,994,321

[45] Nov. 30, 1976

[54] APPARATUS AND METHOD FOR PROGRESSIVELY DELIVERING MATERIALS TO CONTAINERS

[75] Inventor: Bernard C. Eisenberg, Fairfield, N.J.

[73] Assignee: Solbern Corporation, Fairfield, N.J.

[22] Filed: May 7, 1975

[21] Appl. No.: 575,355

[52] U.S. Cl. ..... 141/1; 53/160; 141/12; 141/78; 141/131; 141/182

[51] Int. Cl.² ..... B65B 1/36

[58] Field of Search ..... 53/160; 141/1, 5, 71, 141/73, 74, 77, 78–80, 102, 103, 114, 131, 133, 134, 168, 171, 172, 181, 182, 275, 284, 324, 325, 326, 12; 198/20 C; 222/330

[56] References Cited

UNITED STATES PATENTS

| | | | |
|---|---|---|---|
| 1,893,831 | 1/1933 | Weber | 141/133 X |
| 2,055,075 | 9/1936 | Gardner | 141/133 |
| 3,369,577 | 2/1968 | Johnson et al. | 141/182 X |

FOREIGN PATENTS OR APPLICATIONS

| | | | |
|---|---|---|---|
| 770,173 | 3/1957 | United Kingdom | 198/20 C |

*Primary Examiner*—Richard E. Aegerter
*Assistant Examiner*—Frederick R. Schmidt
*Attorney, Agent, or Firm*—Kenyon & Kenyon Reilly Carr & Chapin

[57] ABSTRACT

A transfer type of product filling machine includes a stationary deadplate positioned under a moving line of openbottom transfer receptacles. Containers moving in a separate line under the deadplate in synchronism with the line of transfer receptacles are progressively filled as the transfer receptacles pass over either a continuously tapered or a stepped termination of the deadplate to prevent bridging of loose materials or individual items across the container openings by abrupt dumping of the materials into the containers. The stepped type of deadplate termination also facilitates exact count filling of a single container from a plurality of intermediate receptacles, each holding an integral fraction of the total count fill, and speeds the filling operation by providing a plurality of filling locations.

42 Claims, 11 Drawing Figures

33
35
36
37
49
20
23
66
21
21a
50
24
26a
26
27
28
17b
32
51
34
B
20a
20
20b
23d
23b
23a
23
31
29
30
52
46
A
12
57
56
58
62
60
63
61
59

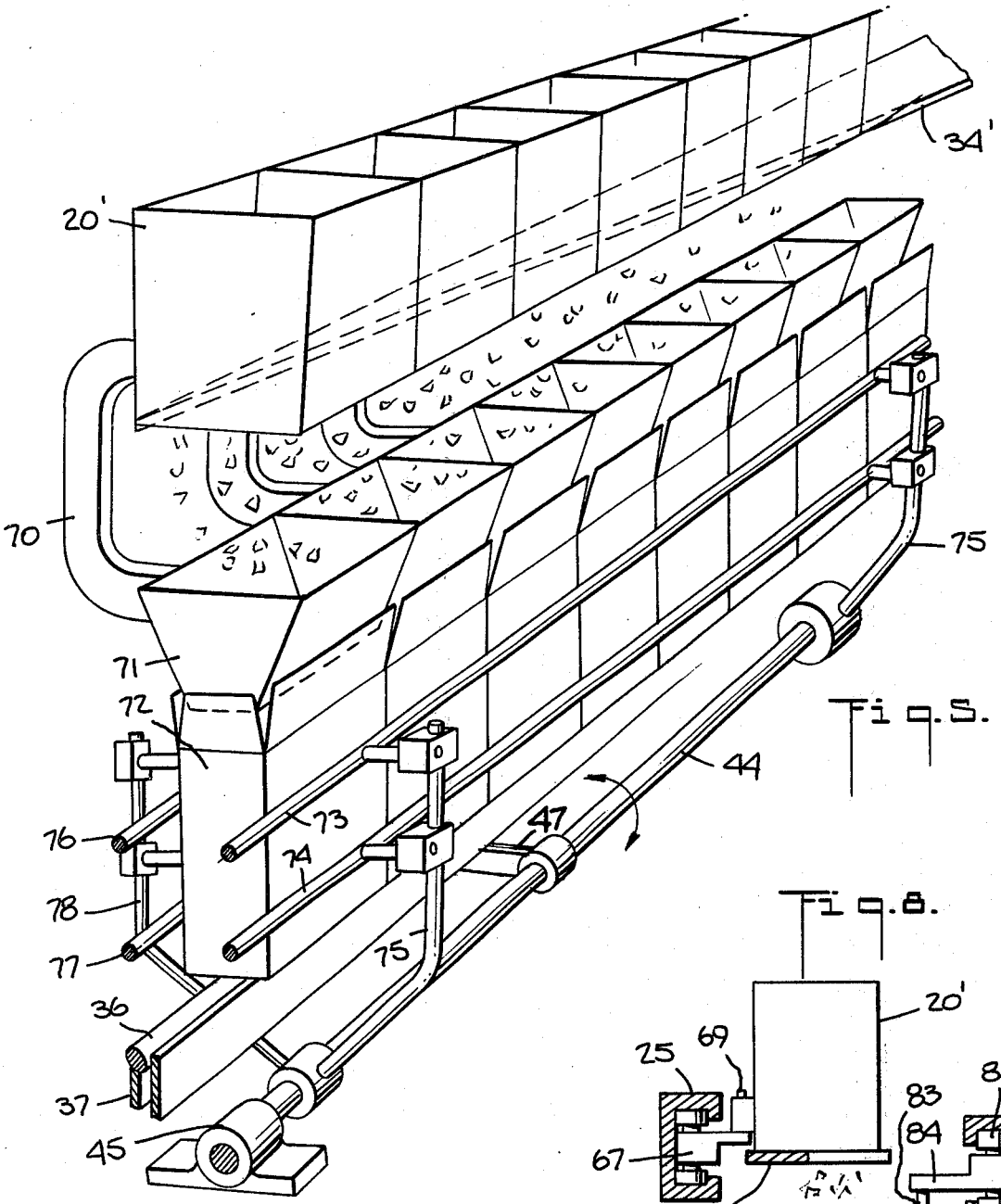
Fig. 5.
Fig. 8.
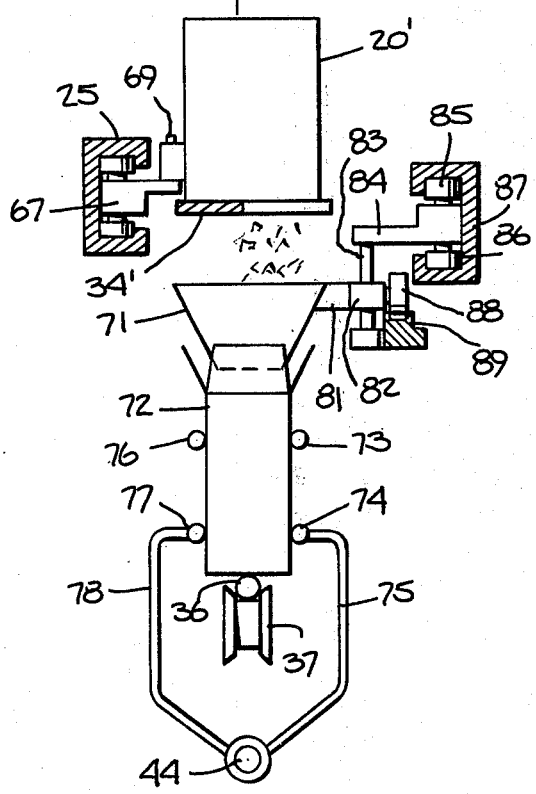
Fig. 6.
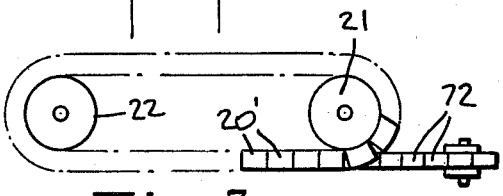
Fig. 7.
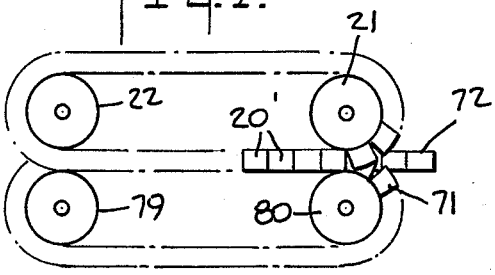

APPARATUS AND METHOD FOR PROGRESSIVELY DELIVERING MATERIALS TO CONTAINERS

BACKGROUND OF THE INVENTION

1. Field of the Invention

This invention relates to container filling machinery and particularly to a machine amd method for transferring a predetermined quantity or number of items from an intermediate receptacle to a final container.

2. Description of the Prior Art

My U.S. Pats. No. 3,517,708 issued June 30, 1970; No. 3,621,891 issued Nov. 23, 1971; and No. 3,696,581 issued Oct. 10, 1972 describe rotary-drum machines for filling intermediate receptacles with predetermined amounts of materials for transfer to ultimate containers, and their disclosures are incorporated in this application by reference.

In these prior machines, elongated rake members spaced circumferentially around a horizontal or inclined drum mounted for rotation about its axis each have a plurality of inward-projecting tines for picking up portions of materials such as food products in the bottom of the drum as the drum rotates and for carrying the portions to a predetermined release point near the top of the drum for discharge onto a chute or shaker tray for delivery into a line of intermediate receptacles extending through the drum. The receptacles are fastened to an endless conveyor that includes means for shaking the receptacles as they are filled to eliminate voids and to obtain a uniform packing density in each receptacle corresponding to a predetermined package amount. After being filled, the intermediate receptacles are transported by the conveyor to a separate station outside the drum where their contents are transferred to a line of ultimate containers on a second conveyor that is synchronized with the movement of the receptacle conveyor.

The present invention is directed to an improvement over the transfer apparatus disclosed in my copending application Ser. No. 588,205 filed on June 19, 1975, which is a continuation of application Ser. No. 423,123 filed on Dec. 10, 1973 now abandoned. That application discloses means for delivering a predetermined number of items of substantially uniform size from a drum-type filling machine to a line of containers. The delivery means comprises a plurality of open-bottom intermediate receptacles transported by an endless conveyor from a filling station inside a revolving drum loader to a delivery station outside the drum.

A stationary base plate or deadplate is positioned under the receptacles and extends from the filling station to the delivery station. The receptacles have flat bottoms that rest on and slide over the base plate between the filling and delivery stations; so that no transferred material drops through the open bottoms of the receptacles until the base plate terminates at the delivery station.

The base plate of my prior application ends abruptly at right angles to the line of travel of the intermediate receptacles. It has been found in certain filling situations that sudden delivery of all the materials in an intermediate receptacle may cause the materials to bridge across the opening of the final container below. The bridged material prevents the remainder from entering the container, resulting in short fills and a product cleanup problem at the final fill location. This becomes a particular problem when the final container has a relatively small opening in relation to its capacity or when the product items are angular or irregular in shape.

Another problem arises when several small intermediate receptacles are needed to assure an exact integral multiple count fill in each final container. This situation occurs with items of non-uniform shape or of a statistical size variation great enough to cause an inexact fill in a given transfer receptacle unless it is sized to hold only a predetermined small numer of the items, the small number being an integral fraction of the total count fill desired in the container.

For example, it might be desired to fill a jar With one dozen bouillon cubes, but the largest receptacle pocket that will consistently hold only a predetermined number of cubes may be one that is sized to hold only three cubes. Then four transfer receptacles, or four separate pockets in one receptacle, will be needed to carry the cubes to fill one container. Having only a single transfer position in this situation complicates the synchronization of the receptacle and container lines and also limits the speed of the conveyor line to a fraction of the speed of the receptacle line.

Still another problem results when it is necessary to fill a container having a small opening in relation to its volume, such as a small mouth jar, or a narrow deep box, such as a dry cereal box, with a predetermined amount of loose materials. In order to rapidly fill a transfer receptacle having the appropriate volume, it is desirable to make the receptacle relatively shallow with straight sides. This results, however, in a mismatch between the large opening area of the transfer receptacle and the small opening area of the final container, and some means is required to channel the flow of material from the receptacle to the container to prevent spilling.

SUMMARY OF THE INVENTION

It is an object of the present invention to provide an apparatus and method for transferring a predetermined amount of solid materials or a predetermined number of items progressively from a moving line of intermediate receptacles to each container in a moving line of final containers to prevent bridging of materials across the opening in the container by too rapid a transfer.

It is another object of the invention to provide an apparatus and method for transferring a predetermined number of items from each of a plurality of separate pockets in a moving line of transfer receptacles at an equal plurality of spaced transfer locations to a single container in a moving line of containers.

Another object of the invention is to provide an apparatus and method for transferring a predetermined number of items from one pocket in each of a plurality of parallel columns of pockets in a line of moving transfer receptacles to a single container in a line of moving final containers.

Another object of the invention is to provide an apparatus for transferring loose materials from a moving line of open bottom, straight sided transfer receptacles to a moving line of open top final containers in which the opening in the top of each final container is smaller in at least one dimension than the opening in the bottom of each transfer receptacle.

These and other objects are achieved in a machine of the type described above that includes a plurality of transfer receptacles each having at least one open pocket for receiving materials at an intermediate filling region and means for conveying the transfer receptacles in a closed path from the intermediate filling region to a final filling region extending over a line of moving final containers, in which the improvement comprises the provision of a stationary deadplate positioned for slidable contact underneath each open pocket of each transfer receptacle and extending with decreasing width along the path of the transfer receptacles in the final filling region for progressively uncovering the openings of the pockets to allow the materials to drop into the containers.

The width of the deadplate may decrease either continuously with distance along the path of the transfer receptacles or discontinuously, that is in stepwise fashion, depending on the type of filling operation. When a container is to be filled with a predetermined amount (i.e. weight or volume) of loose materials from a single receptacle, a deadplate with continuously decreasing width allows the materials to flow gradually from the receptacle to the container below, without bridging across the container opening.

On the other hand, when a container is to be filled with a predetermined total number of items from a plurality of receptacles or receptacle pockets, each holding a fraction of the total number of items, a stepped deadplate will allow progressive discharge from predesignated ones of the receptacles at successive step locations into the same container.

In the latter arrangement, the receptacles or receptacle pockets are arranged in a plurality of columns extending parallel to the path of the receptacles. The width of the deadplate decreases in steps equal to the number of columns, and the line of containers extends diagonally with respect to the path of the receptacles directly below the midpoint of each step. The movements of the two lines are synchronized so that a given container will appear successively beneath each of the deadplate steps as preselected ones of the receptacle pockets in successive columns are respectively uncovered by the same steps. Since each step provides a separate filling position, the stepped deadplate arrangement allows a container filling rate several times faster than would be possible with only a single deadplate termination point.

The stepped deadplate arrangement also permits filling different sizes of containers with different numbers of the same kind of items from the same receptacle sizes. For example, in the bouillon cube filling situation described above, one size of container could be filled with one dozen cubes by delivering three cubes successively from one proper sized receptacle pocket at each of four step locations, the receptacle pockets being arranged in four parallel columns. Larger containers each could be filled, for example, with two dozen cubes from the same receptacle line merely by providing that each container receives the contents from two successive receptacle pockets in each column.

If the container openings are large enough to cover the area under two adjacent receptacle pockets in a column, then the linear speeds of the receptacle and container conveyors can be equal. If the container opening is smaller than this area, however, it will be necessary to adjust the relative speed of the two lines to keep the container under each step filling location long enough for two successive receptacle pockets to discharge their contents into the opening of the container.

Alternatively, a plurality of funnel means may be provided to transfer the contents from one or more adjacent receptacle pockets to a single container when the openings of the receptacle pockets cover a larger area than the opening of the respective final container. The funnel means are mounted on conveying means for transporting the funnel means through the final filling region in synchronism with the transfer receptacles, each funnel means being positioned below the deadplate directly underneath a corresponding one or more receptacle pockets for guiding their entire contents into a single container.

The conveyor means for the funnels may be the same as the conveyor that transports the transfer receptacles, or it may be a separate conveyor that follows a different path than that of the receptacle conveyor except in the final filling region, where the receptacle conveyor, the funnel conveyor, and the final container conveyor all converge. In either arrangement, the funnel conveyor means preferably may include means for moving each funnel means vertically from a first level to a second level with respect to a corresponding final container after the paths of the funnel means and the containers converge. At the first level, the bottom of the funnel is higher than the top of the container to allow the funnels to clear the containers when the two lines converge. At the second level, the bottom of the funnel is surrounded by the top of the container to insure that no materials spill over the edge of the container.

Even with the use of funnels and graduated filling, some types of materials may still bridge across the container openings or cause voids inside the containers. Consequently, the present invention further includes a method and means for shaking the containers as they pass under the deadplate in the final filling region to prevent bridging and voids as the containers are filled.

A preferred shaking means includes an eccentric motor drive for transmitting oscillatory motion through crank arms to a shaft mounted in bearings below and parallel to the line of containers in the final filling region. Guide rails on either side of the line of containers, which are connected to the oscillating shaft by generally U-shaped brackets, impart a lateral shaking motion to the containers as they move through the final filling region.

The same eccentric drive motor can be used also to actuate a shaking mechanism for the transfer receptacles as they pass through the intermediate filling region to assure that each receptacle is properly filled and to remove any excess material from the tops of the receptacles.

The source of items for filling the receptacles in the intermediate filling region preferably includes an open-ended drum mounted for rotation about either a horizontal or slightly inclined axis. The items are delivered to the bottom of the drum, preferably by means of a chute through one of its open ends. Shelf members circumferentially spaced around the inside of the drum carry items, as the drum rotates, from the bottom to a discharge point near the top of the drum. At the discharge point, the items are released, preferably onto a chute or shaker tray from which they are delivered to the receptacles.

Before each receptacle enters the intermediate filling region, it comes into sliding contact with the stationary deadplate. Items then cascade from the chute or tray over the top of the receptacle and fall into individual pockets of the receptacle, if it is subdivided into rows of pockets. The receptacle is simultaneously shaken to aid the filling process and help orient the items in the pockets. The shaking continues for a short distance after the receptacle leaves the intermediate filling region to dislodge any excess items remaining on the top.

A conveyor then transports the receptacle, still sliding along the deadplate so that no items are lost from its open bottom, to a final filling region outside the drum. The final filling region extends above a line of open top containers, with the width of the deadplate progressively decreasing as described above.

Additional features and advantages of the invention will become apparent from the following description of the preferred embodiment as disclosed in the accompanying drawings.

BRIEF DESCRIPTION OF THE DRAWINGS

FIG. 5 is a perspective view of an alternative embodiment of a final filling arrangement according to the invention.

FIG. 6 is a mechanical schematic of the arrangement of receptacle, funnel and final container conveyors of FIG. 5.

FIG. 7 is a mechanical schematic of another arrangement of receptacle, container, and separate funnel conveyors.

FIG. 8 is an end view of the conveyor arrangement of FIG. 7.

DESCRIPTION OF THE PREFERRED EMBODIMENTS

Figure 1:
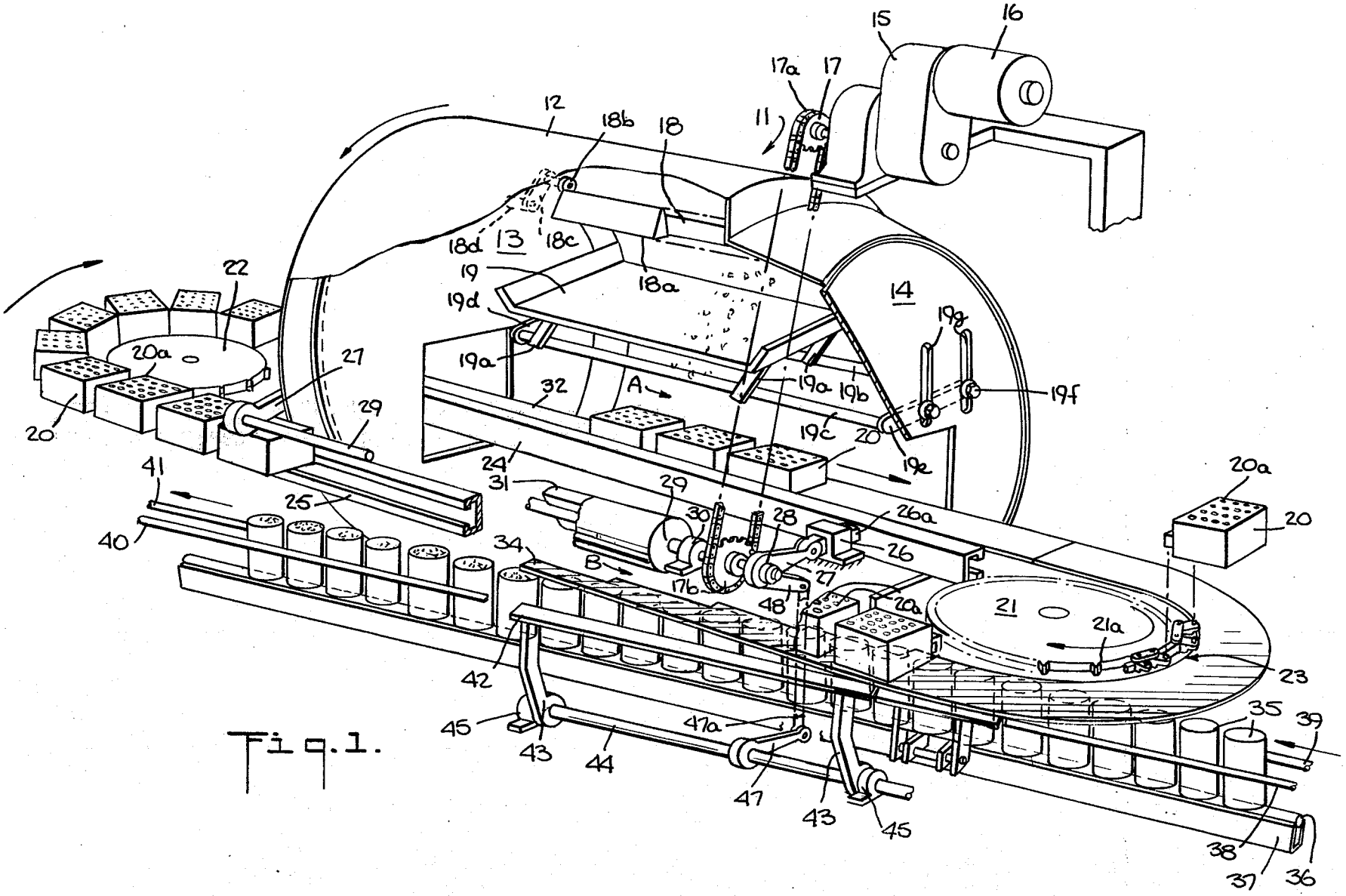
FIG. 1 is a perspective view of the preferred arrangement of the deadplate in the final filling region showing also a cut away drum-type machine for filling the receptacles.

Referring to the drawings, FIG. 1 shows a perspective view of a complete filling apparatus incorporating the improvement of the present invention. A drum-type filling machine 11 of the type fully described in my prior patents incorporated by reference above includes a horizontal open-ended drum 12 supported for rotation about its own axis in a frame, that is not shown to avoid unnecessary detail.

Materials or items to be packaged are introduced into the drum by means of a chute (not shown) through one of the stationary end plates 13 or 14. A variable speed reduction unit 15 driven by an electric motor 16 rotates the drum and also supplies power through a drive chain 17 to an eccentric shaker device that will be described below. As the drum revolves in the direction shown by the arrow, the materials are raised by means of shelves 18 spaced circumferentially around the interior of the drum to a discharge point near the top of the drum, where a flap or dam **18*a* is swung inboard about pivot journal 18*b* by lever arm 18*c*, having a follower 18*d* that rides in a cam track (not shown) fastened to the outside of stationary end plate 13 to allow the materials to slide off the shelves onto a chute or shaker tray 19. Shaker tray 19 is mounted by four parallel pivot legs 19*a* on two longitudinal rails 19*b*, 19*c* joined by end bars 19*d*, 19*e* that in turn are adjustably attached to end plates 13, 14 by bolts 19*f* through slots 19*g*.**

From the lower lip of the shaker tray the items cascade onto a line of transfer receptacles 20 in an intermediate filling region A. The receptacles are coupled to an endless link conveyor line that extends in a straight path through the drum, passes around an idler sprocket wheel 21, doubles back in a straight path along the outside of the drum through a final filling region B, and then passes around a drive sprocket wheel 22 to re-enter the drum.

In the embodiment of FIG. 1, the receptacles 20 are subdivided into transverse rows and longitudinally extending columns of cylindrical, open-bottomed pockets **20*a*.** In the particular embodiment illustrated, there are four pockets in each row and four rows in each receptacle, but any other pocket matrix can be chosen, depending on the receptacle size and desired individual pocket size. The size of each pocket is chosen to hold a predetermined amount of the material being transferred, the amount being a fraction of the total amount desired in each final container.

As described earlier, the subdivided receptacles shown in FIG. 1 are particularly suited for count filling operations in which a specified number of items is to be placed in each final container. The individual pockets in each row will normally be the same size and will hold a fraction of the total number of items for each container equal to the reciprocal of the number of columns of pockets. The pockets in one or more columns may be of a size different than those in the other columns, however, so as to hold different numbers of items. Thus, the arrangement of FIG. 1 is suitable for filling a final container with a total number of items that is not evenly divisible by the number of columns of pockets. For example, a count fill of ten items per container could be accomplished with four columns of pockets, the pockets in three of the columns holding three items each and the pockets in the fourth column holding only one item.

In the straight portions of the path of the transfer receptacles, the conveyor links are guided in a channel member 24 inside the drum filler and in a channel member 25 outside the drum filler. Channel member 24 is mounted by stationary guide structures 26 and slide arms **26*a* which provide lateral oscillatory motion of the channel in response to reciprocation of connecting rod 27 which is driven by eccentric 28 coupled to shaft 29. Shaft 29 is journalled in a pillow block 30 and carries a counterweight 31 which balances the shaking forces of the oscillation, channel 24. Shaft 29 is driven by speed reducer 15 through sprocket 17, chain 17*a* and sprocket 17*b* attached to shaft 29.**

As discussed earlier, lateral shaking of the transfer receptacles as they pass through the cascade of items in the intermediate filling region assists in orienting the items properly in the pockets and in dislodging any excess items left on the tops of the receptacles before the receptacles leave the drum. In this way, the extra items fall back into the drum and are recirculated up to the shaker tray.

Before entering the drum, the bottoms of the receptacles slidably engage a stationary plate or deadplate 32 that prevents any materials from escaping through the open bottoms of the receptacle pockets. After leaving the drum, the receptacles 20 continue around sprocket wheel 21 on a semicircular extension 33 of deadplate 32 and then onto a straight terminal portion 34 of the deadplate in final filling region B. It is the form of this final deadplate portion 34 and its function that is the principal feature of the present invention. This feature will be described in more detail in connection with FIGS. 2 and 5.

Figure 2:
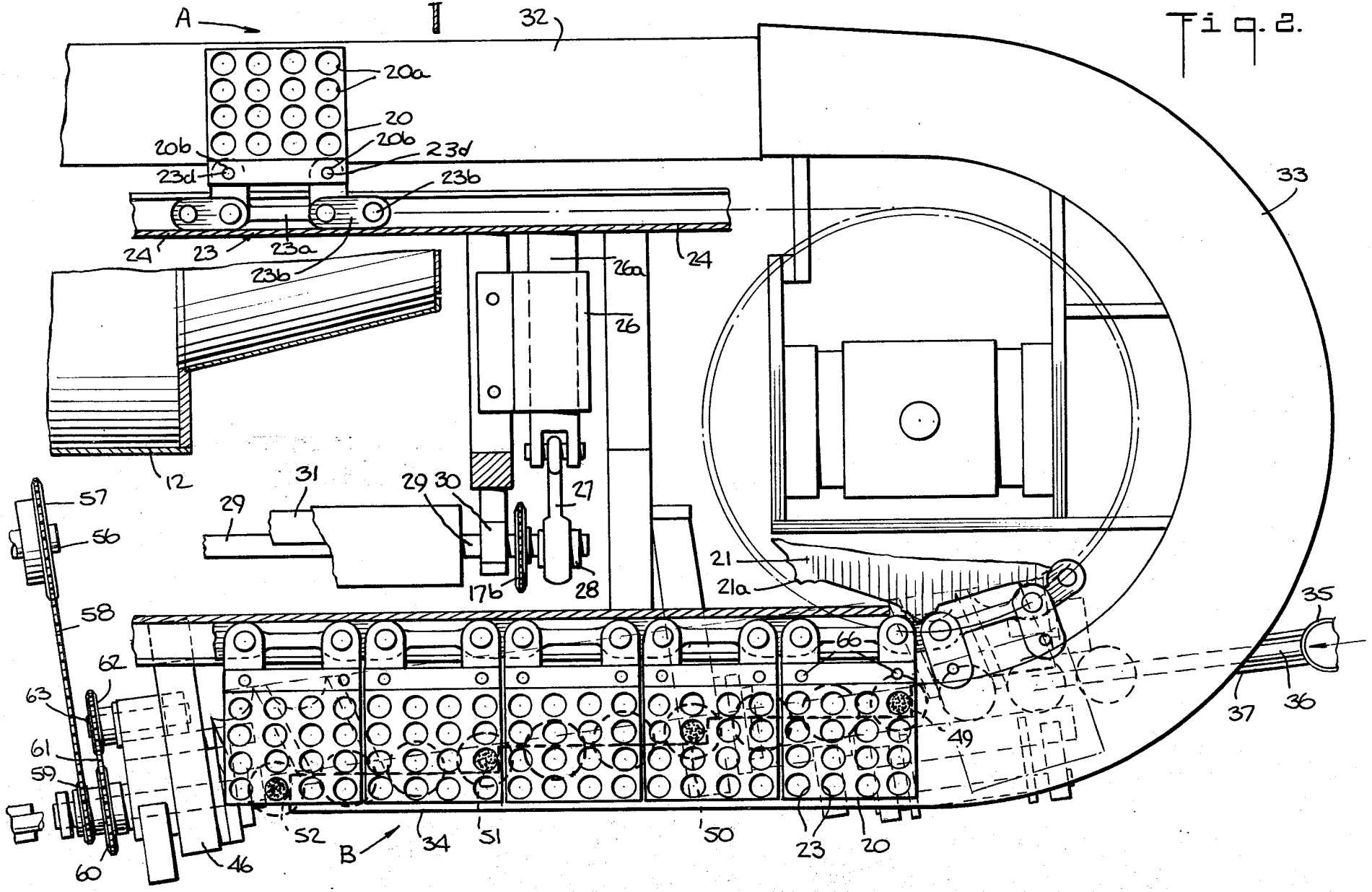
FIG. 2 is an overhead view of the final filling region of the embodiment of FIG. 1.
Figure 4:
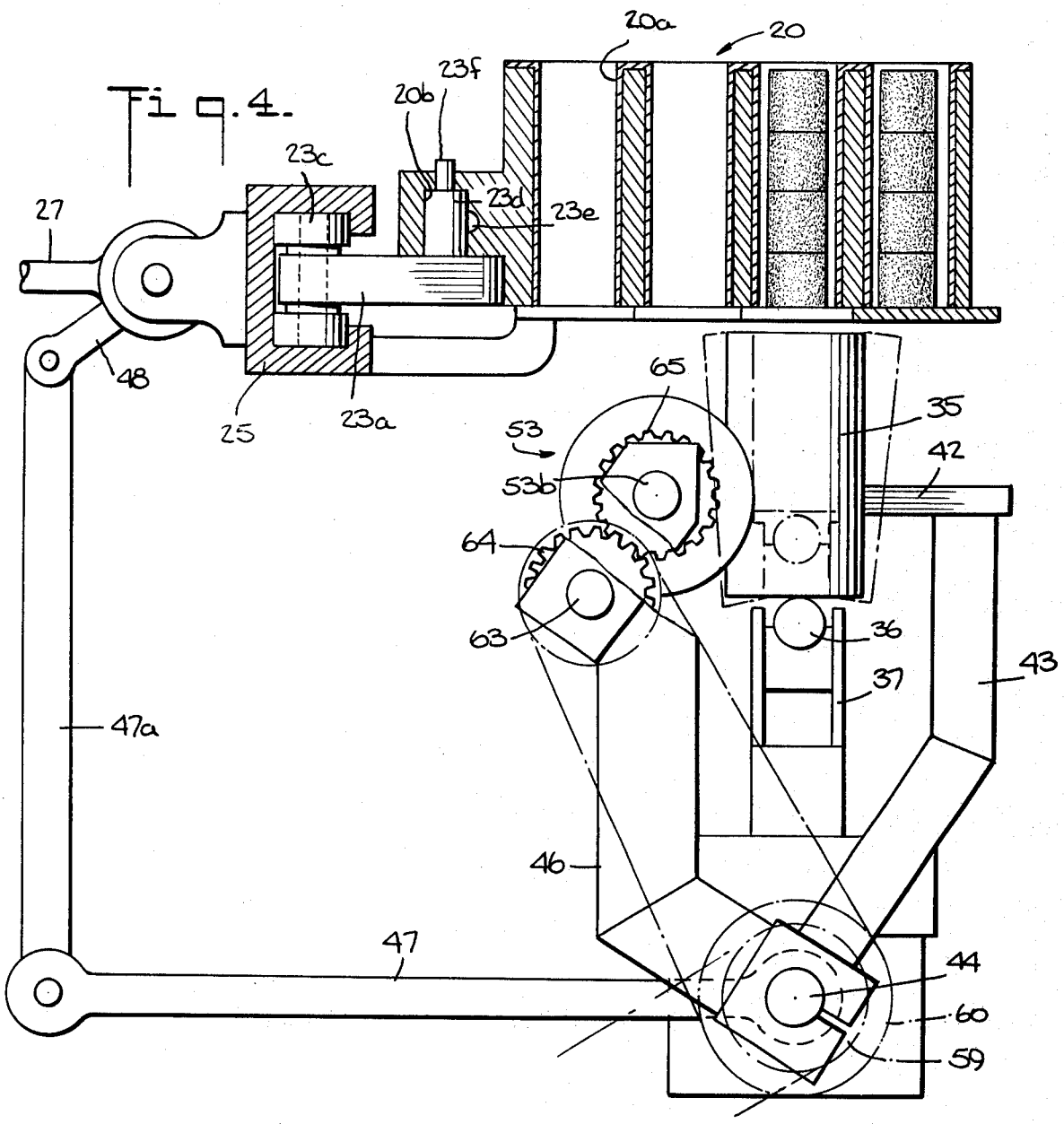
FIG. 4 is an end view of the final filling region taken along the lines 4—4 of FIG. 3.

As shown in FIGS. 1 and 2 above the semicircular portion 33 of the deadplate, the endless link conveyor line 23 is formed by U-shaped receptacle support members 23*a* which are pivotally connected by means of hinge pins 23*b* and intermediate links 23*c*. The intermediate links 23*c* conform to the shape of cogs 21*a* on sprocket wheel 21, as shown in FIG. 2, for positive transmission of the wheel torque to the conveyor line. At the outer end of each arm of the U-shaped members 23*a* there is an upright mounting pin 23*d* (FIGS. 1, 2 and 4). Each receptacle 20 carries a pair of vertical mounting holes 20*b*, spaced apart by a distance equal to the spacing of pins 23*d* of each support member and sized to slidingly fit the pins. It is an easy and quick matter, therefore, to replace receptacles of one size of pockets by receptacles of another size, depending on the product and the number of items desired in each final container 35.

A line of such final containers 35 moves along a linear conveyor 36 supported in a guide channel 37 underneath the terminal portion of the deadplate for filling from the pockets 20*a* of the receptacles 20. Conveyor line 36 is in the form of a single flexible sheathed cable and the containers are supported in an upright position by stationary guide rails 38, 39 and 40, 41, respectively ahead and following the final filling region B (FIG. 1).

Within the final filling region B, a movable side rail 42 is supported at each end by arms 43 which are clamped at their lower ends to a shaft 44 rotatably journalled in bearings 45 (FIG. 3) directly underneath and parallel to conveyor line 36. Side rail 42 fills a portion of the gap between outside rails 38 and 40 (FIG. 1). A similar gap between rails 39 and 41 is closed by a screw-type container synchronizing means 53, shown in and described in connection with FIGS. 3 and 4, which is supported also from shaft 44 by support arms 46.

Figure 3:
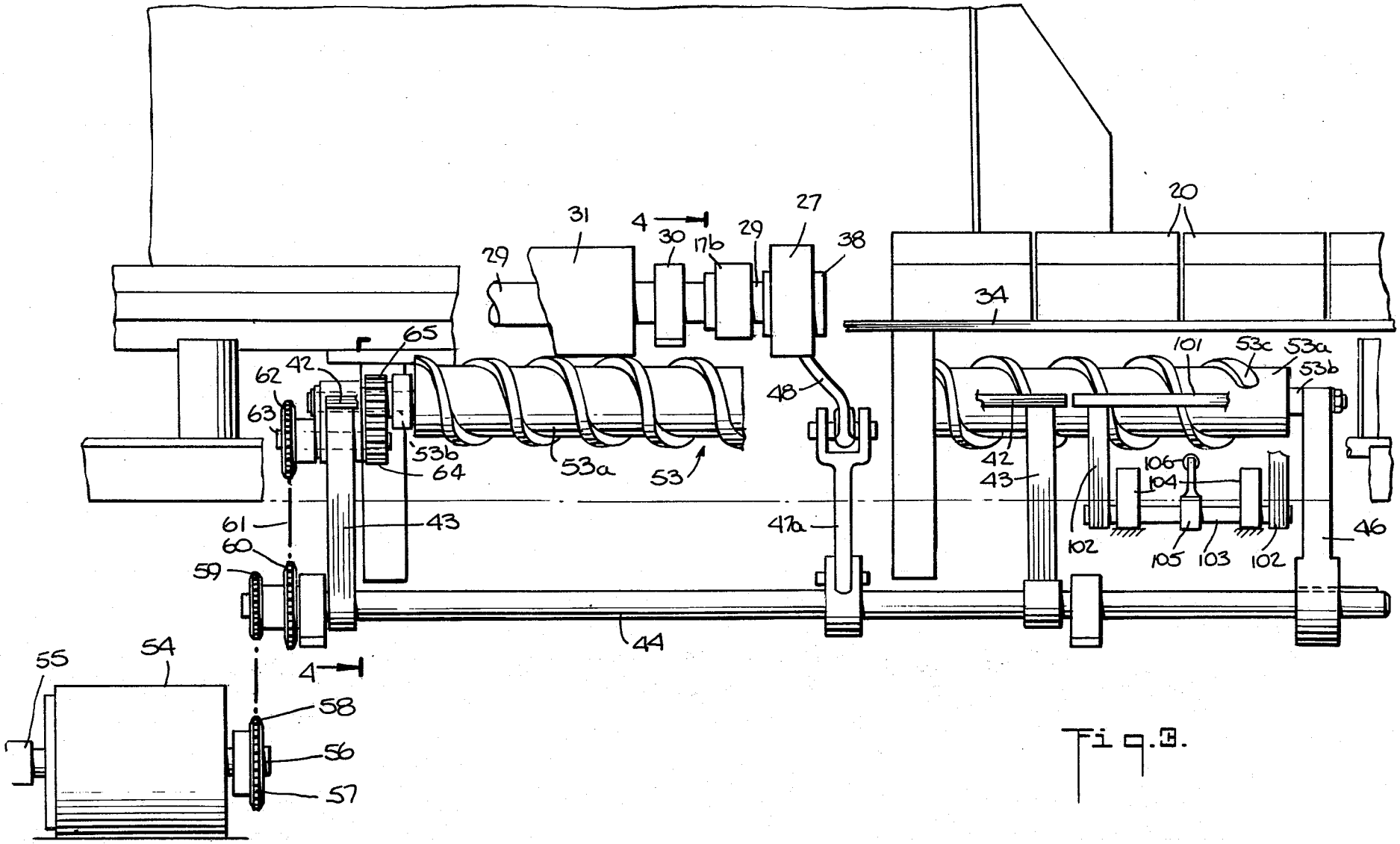
FIG. 3 is a partially cut away side view of the final filling region of the embodiment of FIG. 1 showing the means for synchronizing the movement of the containers with the movement of the transfer receptacles.

The entire container side support assembly in the final filling region is oscillated laterally about shaft 44 by means of a crank arm 47 having one end clamped to the shaft and the other end coupled through a connecting link 47*a* to work arm 48 connected to eccentric 28 with connecting rod 27 (FIGS. 1 and 3). The oscillating assembly in turn shakes the containers as they pass under the terminal portion of the deadplate to prevent bridging or voids as the containers are filled progressively from the transfer receptacle pockets.

Figure 1A:
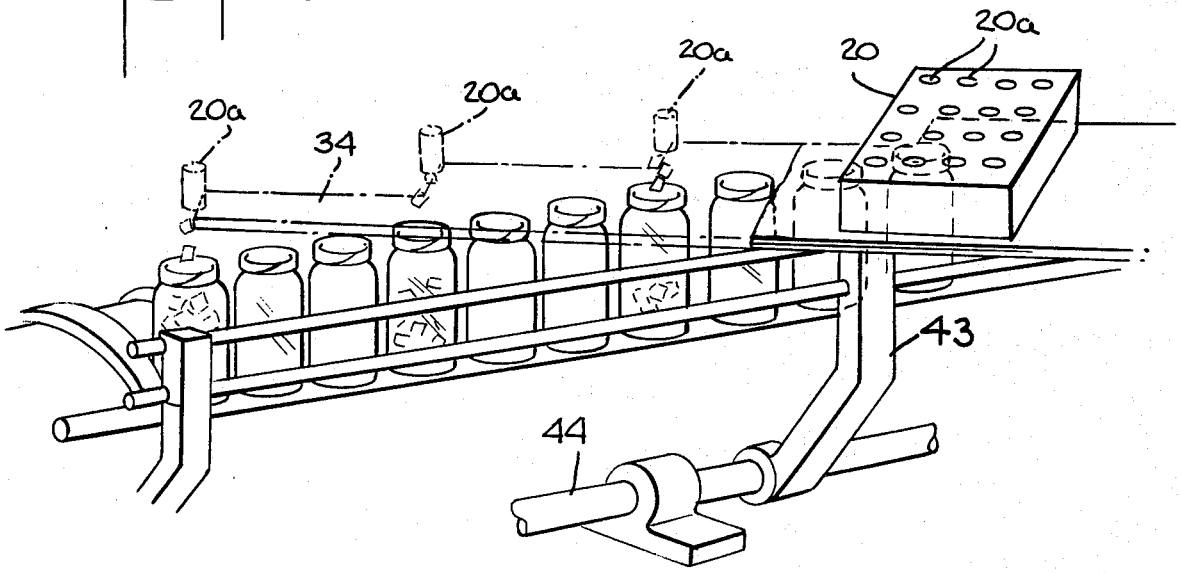
FIG. 1A is a closeup perspective view of a deadplate termination arrangement similar to that of FIG. 1.

The function of the terminal portion 34 of the deadplate in progressively distributing items from preselected pockets to each final container is illustrated in FIG. 1A and FIG. 2. The arrangement in FIG. 1A is the same as in FIG. 1 but is presented to illustrate the operation of the stepped plate more clearly. Starting at a point where the straight terminal portion 34 joins the semicircular portion 33, the width of the deadplate progressively decreases in longitudinally spaced steps 49, 50, 51, and 52, the last step marking the end of the deadplate. The width of each step is equal to the spacing between adjacent columns of receptacle pockets 20*a* and the midpoint of each step lies under the centerline of each corresponding column of pockets. In addition, it will be apparent from FIG. 2 that the midpoint of each step lies directly over the centerline of container conveyor line 36, so that the direction of the conveyor line is skewed in relation to the path of the receptacles through the final filling region.

The longitudinal spacing between successive steps 49 through 52 is chosen preferably to coincide with the spacing between a preselected number of rows of receptacle pockets. In FIG. 2, a step occurs at every sixth pocket row, but any other spacing could be chosen, as desired. The containers also are spaced equally along the container line, and the relative speeds of the receptacle and container lines are preselected so that a container will always be in position under a receptacle pocket as that pocket slides over its respective step. Again in FIG. 2, the containers are spaced so that the distance between three containers is equal to the distance between six receptacle pockets. Therefore, if each container is to receive the contents of one pocket in each column at the step location corresponding to that column, the container line will have to run at twice the linear speed of the receptacle conveyor. On the other hand, if each container is to receive the contents of two adjacent pockets in each column at the step location corresponding to that column, then the linear speeds of the container line and receptacle conveyor will be equal. Other possible combinations of step spacing, container spacking, row spacing, and relative receptacle and container line speeds provide a high degree of flexibility of count fill per container and item size for a given filling machine and deadplate arrangement.

The screw-type means 53 for synchronizing the movement of the line of containers with the movement of the receptacle conveyor, mentioned above, is shown most clearly in the views of FIGS. 2, 3 and 4. The inner support arms 46 carry between their upper ends at approximately the same level as side rail 42 a guide screw 53 journalled in bearings (not shown) for rotation about its own axis. A drive motor 54 is connected through a coupling 55 at one end of its shaft 56 to a transmission system (not shown) for turning drive sprocket wheel 22 (FIG. 1) for the receptacle conveyor 23. The other end of motor shaft 56 is coupled to the shaft of guide screw 53 through a drive sprocket 57, chain 58, first and second intermediate sprockets 59 and 60 mounted for rotation coaxially with shaft 44. Chain 61 and driven sprocket 62 mounted on stub shaft 63 with pinion gear 64 are supported by one of inner support arms 46. Gear 64 meshes with driven gear 65 on the guide screw shaft 53*b*.

Each container 35 fits between adjacent spiral lands 53*b* of the guide screw, and the overall speed ratio between the motor shaft 56 and the guide screw 53 is adjusted to produce the desired linear speed of container travel in relation to the linear speed of the receptacle conveyor that is driven by the same motor.

End portion 53*c* of land 53*b* is tapered to adjacent the surface of guide screw 53 in order to facilitate the entry of a container between the lands of the guide screw (FIG. 3). Movable siderail 101 extends adjacent to the path of travel of the containers entering the lands of guide screw 53. Guide rail 101 is supported by uprights 102 which are attached to shaft 103 pivotally mounted in brackets 104. Arm 105 which is also connected to shaft 103 is biased in a direction extending toward guide screw 53 by spring 106. With this arrangement guide rail 101 is urged against the side of the containers opposite the side thereof engaged by the guide screw as the containers enter the guide screw. In the event that a container is momentarily positioned against the outer surface of line 53*b* of the guide screw, the resilient mounting of guide rail 101 enables the guide rail to deflect and thereby enable the container to be engaged properly with the guide screw without damage to the container.

Also indicated in FIG. 4 is the adaptability of the system to containers of various sizes, a small container being shown in dot-dash lines and a large container in solid lines. If desired, different pitch guide screws can be made up for different standard container sizes. In addition, the height of conveyor line 36 and the position of side rail 42 are preferably adjustably by suitable means (not shown).

The mounting means for receptacles 20, described above in connection with FIG. 1, is shown more clearly in FIG. 4. Each upright pin 23*d* carries a locking detent 23*e* releasably actuated by a plunger 23*f* to permit quick locking and release of the receptacle block.

Referring next to FIG. 5, an alternate embodiment of the invention is shown that is particularly suitable for filling a predetermined amount (e.g. volume) of loose materials gradually from a single receptacle into a container having a different size or shape opening than the opening in the bottom of the receptacle. This embodiment features a terminal portion 34' of the deadplate of the invention that continuously decreases in width to produce a gradual emptying of a transfer receptacle 20' as it passes through the final filling region.

Each receptacle 20' in the embodiment of FIG. 5 has a single pocket, although it is possible to use subdivided receptacles with the gradually tapered deadplate of FIG. 5, if desired. Each receptacle is attached to the receptacle conveyor through the upper branch of a C-shaped yoke 70, attached to a respective link of the receptacle conveyor. The lower branch of the C-shaped yoke carries a funnel means 71 having a flared upper opening of a shape and size to receive all the contents from the receptacle 20' above it and a lower opening of a shape and size to fit within the opening in the top of a container to be filled.

The illustrated container in this embodiment is a pasteboard box 72, such as a dry cereal box, having four top flaps. The funnel means serves the additional functions in this case of holding the top flaps open and keeping each box in registry with its corresponding transfer receptacle. Consequently, the screw-type synchronizing means is not required in this embodiment, and a simple arrangement of outer guide rails 73, 74 supported by arms 75 and inner guide rails 76, 77 supported by arms 78 suffices both to support boxes 72 and to transmit lateral oscillatory motion from the eccentric drive described previously for preventing bridging and voids in the materials being discharged into the boxes.

As shown in FIGS. 6 and 7, the funnel means can be incorporated into the filling system in two different ways. In the embodiment of FIG. 6, a funnel is mounted directly underneath each receptacle, as in FIG. 5. In the embodiment of FIG. 7, the funnels 71 are mounted on a separate endless conveyor similar to the receptacle conveyor but displaced to one side so that only one side of the funnel conveyor coincides with the final filling side of the receptacle conveyor, as shown.

The funnel conveyor has a driving wheel 79 and an idler wheel 80, similar to the corresponding wheels for the receptacle conveyor. The drive wheels of both conveyors are turned in synchronism but in opposite directions in order to coordinate the funnel movement with the receptacle movement in the final filling region.

FIG. 8 shows an end view of the embodiment of FIG. 7, to illustrate the respective levels of the receptacles and funnels in the final filling region as well as a preferred arrangement for engaging a funnel 71 inside the opening flaps of a corresponding box 72. As shown in the drawing, funnel 71 is attached by an arm 81 to a sliding bushing 82 that is mounted on a vertical post 83 carried by a link 84 of the funnel conveyor. Link 84 is supported by upper and lower guide wheels 85 and 86, respectively, in an elongated channel 87 that is positioned parallel to the similar outside channel 25 of the receptacle conveyor so that the funnels will follow a path directly under the receptacles through the final filling region.

On the side of vertical bushing 82 opposite arm 81 is a follower wheel 88 that rides on a fixed track 89 that is secured to the frame structure of the funnel conveyor by any suitable means (not shown) and extends parallel to channel member 87 through the final filling region. The height of track 89 drops from a first level, at which the bottom of the funnel is maintained by follower wheel 88 above the top of the corresponding box 72 as the funnel conveyor and line of boxes converge at the entrance to the final filling region, to a second level, at which the bottom of the funnel is below the edges of the flaps and surrounded by the box opening, as shown in FIG. 8. The track subsequently rises again at the exit from the final filling region to allow the funnel to disengage from the box.

Although FIGS. 5 and 8 illustrate the use of funnel means to channel materials from the transfer receptacles to the final containers in combination with the continuously tapered type of deadplate termination, such means may also be used with the step-type of deadplate termination and with the earlier described arrangement of parallel columns of receptacle pockets. In addition, the arrangement of separate pockets in parallel columns may be used with deadplate terminal portions of continuously decreasing width, if desired. Also the post and bushing funnel support arrangement of FIG. 8 can be adapted to the C-shaped yoke support of FIG. 5 as a means for engaging and disengaging each funnel from a corresponding box or other type of open top container.

Figure 9:
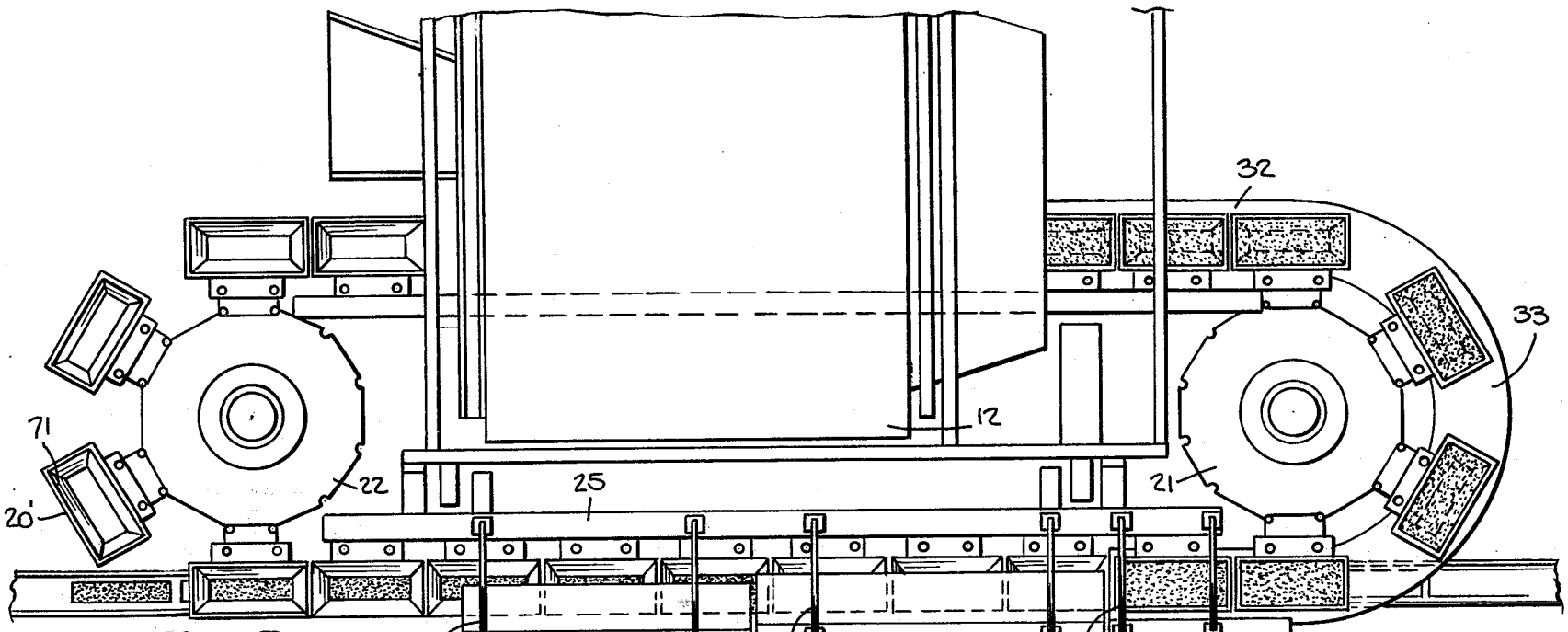
FIG. 9 is a top view of an alternate embodiment having laterally adjustable deadplate sections in the final filling region.
Figure 10:
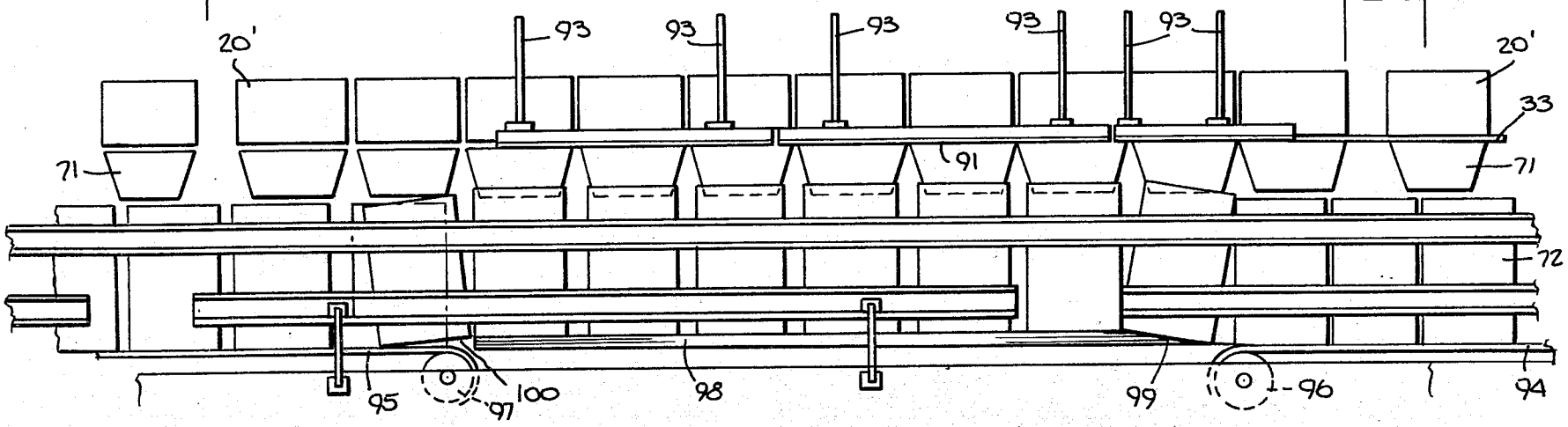
FIG. 10 is a side view of the embodiment of FIG. 9.

FIGS. 9 and 10 illustrate still another embodiment of the invention in which separate plate sections 90, 91, and 92 form individually adjustable deadplate steps in the final filling region. Each plate section is suspended at its outer margin from the outer ends of a pair of inverted U-shaped arms 93. The inner ends of arms 93 are anchored to the top of channel member 25. Each arm is laterally adjustable; so that the lateral offset distance of one plate in relation to the previous plate can be varied to suit the particular conditions of the transfer operation.

The transfer arrangement in this embodiment is similar to that of FIG. 5; namely, a funnel 71 is spaced vertically below each open rectangular receptacle 20' by a distance sufficient to provide clearance for the deadplate between the two. As shown in FIG. 10, however, there is a different arrangement for introducing each funnel into the top of a corresponding final container 72.

The conveyor system for the final containers in this embodiment consists of two endless belt conveyors 94 and 95 in tandem. The end roller 96 of belt 94 is located prior to the final filling region, and the first roller 97 of belt 95 is located after the final filling region. An elevated slide plate 98, with entrance ramp 99 and exit ramp 100, extends between end roller 96 and first roller 97. As is shown in the drawing, the final container boxes leave belt 94 at end roller 96 and slide up entrance ramp 99 and then along slide plate 98. The boxes are pushed along the slide plate by the following boxes moving with belt 94.

The speeds of the receptacle line and the final container conveyor lines are synchronized so that a funnel 71 arrives at the entrance ramp 99 coincidentally with a box 72. The box then rises on ramp 99 so that its upper edge surrounds the bottom of the funnel. At the other end of the slide plate, the boxes disengage from the funnels as they slide down exit ramp 100 and onto the second conveyor belt 95.

I claim:

1. In a machine for transferring material from an intermediate filling region to a line of moving containers in a final filling region spaced from the intermediate filling region of the type that includes a plurality of transfer receptacles each having at least one open pocket for receiving the materials to be transferred, means for delivering a predetermined amount of the materials to each of the pockets of the transfer receptacles at the intermediate filling region, means for conveying the transfer receptacles in a closed path from the intermediate filling region over the line of moving containers in the final filling region and return, means for synchronizing the movement of the transfer receptacles with the moving containers through the final filling region, and means for discharging the materials by gravity from the openings of the pockets in the transfer receptacles into the containers in the final filling region, the improvement wherein the means for discharging the materials from the transfer receptacles comprises:

a stationary deadplate positioned for slidable contact with the opening of each pocket of each transfer receptacle, the deadplate extending laterally underneath the receptacles from one side to the other of the path traversed by the open pockets of the receptacles at the entrance to the final filling region for preventing the contents of the pockets from dropping through the openings in response to gravity until the opening in each pocket is no longer covered by the deadplate, and the deadplate extending longitudinally along the path of the transfer receptacles from the entrance of the final filling region for a least the length of one of the receptacle pockets, with the width spanned by the deadplate in the path traversed by the open pockets decreasing to the end of the final filling region as a function of distance from the entrance thereof for progressively uncovering the openings of the pockets to allow the materials to drop into the containers progressively as the transfer receptacles are conveyed through the final filling region.

2. The machine of claim 1 wherein the width spanned by the deadplate decreases continuously with distance in the path of the transfer receptacles through the final filling region.

3. The machine of claim 1 wherein the width spanned by the deadplate decreases in a series of steps in the path of the transfer receptacles through the final filling region.

4. The machine of claim 1 wherein the deadplate comprises:

a plurality of separate rectangular plate sections positioned end to end through the final filling region, each plate section providing a step of selectable width from one section to the next in the path of the transfer receptacles.

5. The machine of claim 1 further comprising means for shaking the containers in the final filling region to prevent bridging of the materials across the container openings or voids inside the containers.

6. The machine of claim 1 wherein;

each transfer receptacle has at least one row of a predetermined number of spaced open pockets extending transversely to the path of the receptacles, each pocket being sized to accommodate a predetermined fraction of the total materials to be transferred to each receptacle.

7. The machine of claim 6 wherein the width of the deadplate decreases in a number of steps spaced along the path of the transfer receptacles in the final filling region corresponding to the number of pockets in each row, the width of each step being equal to the spacing between adjacent pockets in the row; and the line of containers in the final filling region extends diagonally with respect to the path of the transfer receptacles and directly below the midpoint of each step.

8. The machine of claim 1 wherein:

each transfer receptacle has at least one row of a predetermined number of equally spaced open pockets, the row extending transversely to the path of the receptacles, each pocket being sized to accommodate exactly that fraction of the total materials to be transferred to each container that is equal to the reciprocal of an integral multiple of the number of pockets in the row;

the line of containers extends diagonally below the deadplate through the final filling region; and the width of the deadplate decreases in a number of equal steps along the path of the transfer receptacles corresponding to the number of pockets in each row, the width of each step being equal to the spacing between pockets in the row, and the spacing of the steps along the path of the transfer receptacles being such that the center points of the steps lie on a straight line parallel to and directly above the line of containers.

9. The machine of claim 1 wherein each receptacle has at least two pockets spaced laterally from each other, and the width spanned by the deadplate decreases in a series of steps from the entrance to the exit of the final filling region, the width of each step spanning thE opening of a corresponding one of each of said pockets.

10. The machine of claim 1 wherein each receptacle has four equal pockets spaced laterally by equal distances from one another, and the width spanned by the deadplate decreases in a series of four equal steps from the entrance to the exit of the final filling region, the width of each step being equal to the lateral spacing between adjacent ones of the four pockets, and the midpoint of each step lies on the path of the center of a corresponding one of each of the four pockets.

11. The machine of claim 10 wherein the center of the line of containers passes directly under the midpoint of each step.

12. The machine of claim 11 wherein the relative movements of the transfer receptacles and the containers are synchronized such that the same container receives the contents from a different pocket as the container passes each step of the deadplate in succession.

13. The machine of claim 1 wherein each receptacle has one pocket, the width of the deadplate decreases in a straight line from the entrance to the exit of the final filling region so that the opening in the bottom of the pocket is completely uncovered at said exit, and the transfer receptacles are so synchronized with the containers that a single container is positioned directly underneath the pocket of each transfer receptacle as the receptacle is conveyed from the entrance to the exit of the final filling region for progressively receiving the entire contents of said pocket.

14. In a machine for transferring materials from an intermediate filling region to a line of moving containers in a final filling region spaced from the intermediate filling region of the type that includes a plurality of transfer receptacles each having at least one open pocket for receiving the materials to be transferred, means for delivering a predetermined amount of the materials to each of the pockets of the transfer receptacles at he intermediate filling region, means for conveying the transfer receptacles in a closed path from the intermediate filling region over the line of moving containers in the final filling region and return, means for synchronizing the movement of the transfer receptacles with the moving containers through the final filling region, and means for discharging the materials by gravity from the openings of the pockets in the transfer receptacles into the containers in the final filling region, the improvement comprising:

a plurality of funnel means;

means for conveying the funnel means through the final filling region in synchronism with the transfer receptacles, each funnel means being positioned by the funnel conveying means in the final filling region directly underneath at least one pocket of a corresponding receptacle for guiding the entire contents of the at least one pocket into one of the containers; and wherein the means for discharging the materials from the transfer receptacles includes:

a stationary deadplate positioned for slidable contact with the opening of each pocket of each transfer receptacle, the deadplate extending laterally underneath the receptacles from one side to the other of the path traversed by the open pockets of the receptacles at the entrance to the final filling region for preventing the contents of the pockets from dropping through the openings in response to gravity until the opening in each pocket is no longer covered by the deadplate, and the deadplate extending longitudinally along the path of the transfer receptacles from the entrance of the final filling region for at least the length of one of the receptacle pockets, with the width spanned by the deadplate in the path traversed by the open pockets decreasing to the end of the final filling region as a function of distance from the entrance thereof for progressively uncovering the openings of the pockets to allow the materials to drop into the containers progressively as the transfer receptacles are conveyed through the final filling region.

15. The machine of claim 14 further comprising:

a plurality of upright posts attached to the mears for conveying the funnel means through the final filling region at spaced intervals along the conveying means equal to the spacing between adjacent containers in the line of containers, a coupling member attached to each funnel means and slidably mounted on a corresponding one of the upright posts for vertical movement of the coupling member with respect to the upright post between a first level where the bottom of the funnel means is higher than the opening of the corresponding container to a second level where the bottom of the funnel means is surrounded by the opening of the container, an elongated stationary track member extending alongside the funnel conveying means, the track member having a height corresponding to the first level for a distance preceding the final filling region and dropping to a height corresponding to the second level through the final filling region, and a track follower attached to the coupling means for moving the coupling member vertically on the upright post in response to changes in height of the track member.

16. The machine of claim 14 wherein the funnel means and the containers converge in the final filling region from separate paths, and the apparatus further comprises means for moving each funnel means vertically with respect to a corresponding container after the paths of the funnel means and containers converge from a first level where the bottom of the funnel is higher than the top of the container to a second level where the bottom of the funnel is surrounded by the top of the container.

17. The machine of claim 14 further comprising means for coupling each funnel means to a corresponding one of the transfer receptacles for movement therewith by the receptacle conveying means.

18. The machine of claim 14 further comprising means for elevating the line of containers as they pass through the final filling region to a level at which the bottom of each funnel is surrounded by the top of a corresponding container.

19. The machine of claim 18 wherein the means for elevating the line of containers comprises a plate extending through the filling region at a level above the base level of the line of moving containers, the plate having an inclined entrance ramp for guiding the bottoms of the containers from the base level to the elevated level of the plate.

20. The machine of claim 14 further comprising means for moving the containers vertically with respect to the funnel means from a first relative level prior to the final filling region at which the bottom of the funnel means is higher than the opening of a corresponding container to a second relative level in the final filling region at which the bottom of the filling means is surrounded by the opening of the container.

21. The machine of claim 14 wherein the top of the funnel means is spaced vertically below the bottom of the corresponding transfer receptacle means by a distance sufficient to provide sliding clearance for the deadplate.

22. The machine of claim 14 further comprising:

a plurality of mounting means attached to the means for conveying the funnel means through the final filling region at spaced intervals along the conveying means equal to the spacing between adjacent containers in the line of containers, coupling means attached to each funnel means for coupling the funnel means to a respective one of the mounting means for relative vertical movement of the coupling means with respect to the mounting means between a first level where the bottom of the funnel means is higher than the opening of the corresponding container to a second level where the bottom of the funnel means is surrounded by the opening of the container, and means for lowering the coupling means from the first level to the second level in the final filling region.

23. In a machine for transferring materials from an intermediate filling region to a line of moving containers in a final filling region spaced from the intermediate filling region of the type that includes a plurality of transfer receptacles each having at least one open pocket extending completely through the receptacle, means for conveying the transfer receptacles in a closed path from the intermediate filling region over the line of moving containers in the final filling region and return, means for covering the openings in the bottoms of the pockets of the transfer receptacles to prevent the contents of the pockets from dropping through the open bottoms as the receptacles are conveyed from the intermediate filling region to the final filling region, a drum open at both ends surrounding the path of the transfer receptacles at the intermediate filling station with its axis extending generally in the direction of said path, means for delivering a supply of the materials to be transferred to the bottom of the drum, means for rotating the drum about its axis, means spaced around the interior surface of the drum for raising portions of the material in the bottom of the drum to a delivery position above the transfer receptacles as the drum rotates, means for delivering a cascade of the materials from the raising means at the delivery position onto the tops of the transfer receptacles for filling each open pocket with said materials, means for synchronizing the movement of the transfer receptacles with the moving containers through the final filling region, and means for uncovering the bottoms of the pockets of the transfer receptacles for permitting the contents to fall into the containers in the final filling region, the improvement wherein the means for uncovering the bottoms of the transfer receptacle pockets comprises:

a stationary member having a flat upper surface with a width spanning the width of the receptacles at the entrance to the final filling region and with a length extending from the entrance to the exit of the final filling region for at least the length of one of the receptacle pockets at a level to make sliding contact with the bottom surfaces of the transfer receptacles to prevent loss of material from any pocket until the bottom portion of said pocket is no longer completely covered by said surface, the width spanned by said member in the path traversed by the open pockets of the transfer receptacles decreasing from the entrance to the exit end of the final filling region as a function of distance from the entrance thereof to allow the materials to drop from the bottoms of the pockets into the containers progressively as the transfer receptacles are conveyed through the final filling region.

24. The machine of claim 23 wherein the width spanned by the stationary member decreases continuously from the entrance to the exit of the final filling region to completely uncover the bottoms of the pockets of each receptacle as it passes through said region.

25. The machine of claim 24 wherein the width spanned by the stationary member decreases in a straight line from the entrance to the exit of the final filling region.

26. The machine of claim 23 wherein the stationary member comprises:

a plurality of separate sections positioned in tandem from the entrance to the exit of the final filling region, each section spanning the width of the receptacles and having a longitudinal edge extending parallel to the path of the transfer receptacles through the final filling region, each section providing a selectable stepped decrease in the width of the member spanning the path of the receptacles from one section to the next.

27. The machine of claim 23 wherein each receptacle has at least two pockets spaced laterally from each other, and the width spanned by the stationary member decreases in a series of steps from the entrance to the exit of the final filling region, the width of each step spanning the bottom opening of a corresponding one of said pockets.

28. The machine of claim 27 wherein the center of the line of containers passes directly under the midpoint of each step, and the relative speed of the transfer receptacles and containers is synchronized so that the same container receives the entire contents from a different one of the pockets as the container passes each step of the stationary member in succession.

29. A method for transferring materials from a predetermined number of open bottom pockets in transfer receptacles to each one of a line of open top containers comprising the steps of:

arranging a plurality of the pockets in the transfer receptacles into a selected number of parallel columns, advancing the columns of pockets with the open bottoms thereof in contact with a stationary plate that spans the full width of the open bottoms of the pockets in the transfer receptacles from an intermediate filling region to a final filling region where the width spanned by the plate in the path of the receptacles decreases in longitudinally spaced steps equal in width to the spacing between adjacent columns of pockets, the midpoint of each step lying under the centerline of a corresponding column and directly over the line of containers, filling each pocket in the intermediate filling region with a predetermined fraction of the total amount of materials to be transferred to each open top container, and synchronizing the movement of the line of containers with the advance of the columns of pockets so that each container is positioned to receive the contents of a predetermined one of the pockets in each column as the container passes from under the stationary plate at each of the corresponding steps.

30. The method of claim 29 further comprising the steps of:

shaking the receptacles in the intermediate filling region to insure that they are properly filled and to remove excess materials from the tops of the receptacles and shaking the containers in the final filling region to prevent bridging of the materials across the openings or voids inside the containers.

31. A method for transferring materials from open bottom pockets in transfer receptacles to a line of open top containers comprising the steps of:

filling each pocket in each receptacle with material in an intermediate filling region;

placing the open bottoms of the filled pockets in the receptacles in sliding contact with a plate that spans the full width of the pocket openings;

advancing the receptacles in a line through a final filling region that extends longitudinally for at least the length of one receptacle opening, with the width spanned by the plate in the path of the pocket openings decreasing as a function of distance from the entrance to the end of the final filling region; and moving the line of open top containers through the final filling region underneath the plate in synchronism with the advancing receptacles for progressively filling each container with a predetermined amount of material from a corresponding receptacle.

32. The method of claim 31 wherein the width spanned by the plate in the path of the pocket openings decreases in discontinuous steps from the entrance to the end of the final filling region.

33. The method of claim 31 wherein the width spanned by the plate in the path of the pocket openings decreases as a continuous function of distance from the entrance to the end of the final filling region.

34. The method of claim 31 wherein the width spanned by the plate in the path of the pocket openings decreases as a straight line function of distance from the entrance to the end of the final filling region.

35. The method of claim 31 further comprising the steps of:

shaking the receptacles in the intermediate filling region to insure that they are properly filled and to remove excess materials from the tops of the receptacles and shaking the containers in the final filling region to prevent bridging of the materials across the openings or voids inside the containers.

36. A method for transferring materials from a plurality of open bottom pockets in transfer receptacles to a line of open top containers of the type that includes the steps of:

locating a drum, open at both ends and equipped with material lifting members spaced around the interior surface of the drum, at an intermediate filling station with its axis approximately horizontal;

conveying the transfer receptacles in a closed path through the drum approximately parallel to the drum axis to a final filling region spaced from the intermediate filling region and returning to the entrance of the drum;

introducing materials to be transferred into the bottom of the drum, rotating the drum about its axis to raise a portion of the materials with each of the material lifting members to a delivery location above the transfer receptacles;

cascading the materials from the lifting members at the delivery location over the tops of the receptacles as they are conveyed through the intermediate filling region to fill each receptacle with a predetermined amount of the materials;

placing the open bottoms of the pockets in the receptacles in sliding contact with a flat surface that spans the full width of the pocket openings and extends from the entrance of the intermediate filling region to the final filling region to prevent the materials from dropping through the open bottoms of the pockets in response to gravity as the filled pockets in the receptacles are conveyed from the intermediate filling region to the final filling region, wherein the improvement comprises:

extending the flat surface in sliding contact with the open bottoms of the receptacles into the final filling region, with the width spanned by said surface in the path of the pockets in the receptacles decreasing as a function of distance from the entrance to the end of the final filling region over a distance at least equal to the full length of one pocket opening; and moving the line of open top containers through the final filling region underneath the plate in synchronism with the advancing receptacles for progressively filling each container with a predetermined amount of material from a predetermined number of the pockets in the receptacles.

37. The method of claim 36 further comprising the step of shaking the receptacles laterally on the sliding surface inside the drum to insure that they are properly filled and to remove excess materials from the tops of the receptacles.

38. The method of claim 36 further comprising the step of shaking the containers in the final filling region to prevent bridging of the materials across the openings of the containers and to eliminate voids inside the containers.

39. The method of claim 36 wherein the width of the surface in the path of the pockets in the receptacles decreases in discontinuous steps from the entrance to the end of the final filling region.

40. The method of claim 39 wherein each receptacle includes at least two open bottom pockets spaced laterally from each other, and the width of each of said discontinuous steps spans the bottom opening of a corresponding one of the pockets.

41. The method of claim 40 further comprising the step of angling the line of containers in the final filling region with respect to the path of the transfer receptacles so that the center of the line of containers passes directly under the midpoint of each step.

42. The method of claim 41 wherein the step of moving the containers in synchronism with the transfer receptacles in the final filling region comprises adjusting the speed of the containers relative to the speed of the transfer receptacles so that the same container receives the entire contents from a predetermined different one of the pockets as the container passes from underneath each step in succession.

* * * * *